US005896770A

United States Patent [19]

Hioki et al.

[11] Patent Number: 5,896,770

[45] Date of Patent: Apr. 27, 1999

[54] METHOD AND APPARATUS FOR ROLLING SHAPE STEEL

[75] Inventors: Takeshi Hioki; Suefusa Shimizu; Tatsuya Hokimoto, all of Kitakyushu, Japan

[73] Assignee: Nippon Steel Corporation, Tokyo, Japan

[21] Appl. No.: 08/913,023

[22] PCT Filed: Dec. 19, 1996

[86] PCT No.: PCT/JP96/03714

§ 371 Date: Aug. 12, 1997

§ 102(e) Date: Aug. 12, 1997

[87] PCT Pub. No.: WO97/23310

PCT Pub. Date: Jul. 3, 1997

[30] Foreign Application Priority Data

Dec. 21, 1995 [JP] Japan ..... 7-350623
Jan. 23, 1996 [JP] Japan ..... 8-030070

[51] Int. Cl.[6] ..... B21B 41/06

[52] U.S. Cl. ..... 72/229; 72/225; 72/234; 72/366.2

[58] Field of Search ..... 72/221, 224, 225, 72/226, 234, 238, 229, 237, 252.5, 365.2, 366.2

[56] References Cited

U.S. PATENT DOCUMENTS

| | | | |
|---|---|---|---|
| 4,370,877 | 2/1983 | Michaux | 72/225 |
| 4,400,962 | 8/1983 | Michaux | 72/225 |
| 4,408,475 | 10/1983 | Mennel | 72/221 |
| 4,637,241 | 1/1987 | Michaux | 72/225 |
| 4,966,026 | 10/1990 | Nishino | 72/224 |
| 5,107,695 | 4/1992 | Vandenbroucke | 72/226 |
| 5,287,715 | 2/1994 | Kusaba | 72/225 |

FOREIGN PATENT DOCUMENTS

| | | | |
|---|---|---|---|
| 272616 | 10/1989 | Germany | 72/226 |
| 54-110955 | 8/1979 | Japan . | |
| 58-199601 | 11/1983 | Japan | 72/226 |
| 61-86001 | 5/1986 | Japan | 72/221 |
| 2-187201 | 7/1990 | Japan | 72/221 |
| 3-18401 | 1/1991 | Japan . | |
| 4-270012 | 9/1992 | Japan | 72/226 |
| 1301501 | 4/1987 | U.S.S.R. | 72/221 |

*Primary Examiner*—Joseph J. Hail, III
*Assistant Examiner*—Ed Tolan
*Attorney, Agent, or Firm*—Kenyon & Kenyon

[57] ABSTRACT

A rolling method, and an apparatus therefor, capable of improving a fundamental unit of rolling rolls, dimensional accuracy and rolling stability, and having high productivity are described. The rolling method, and the apparatus therefor, reverse roll a to-be-rolled material having a dog bone-like shape and rough rolled by a single or plurality of breakdown mills BD, etc, by using an intermediate universal mill UR for carrying out X-shape rolling, a quick shift edger mill QE having a plurality of box calibers having different sizes, for carrying out edging rolling by quickly shifting one of the box calibers corresponding to a pass schedule, and a finish universal mill UF for carrying out H-shape rolling for raising flanges on both sides.

6 Claims, 8 Drawing Sheets

METHOD AND APPARATUS FOR ROLLING SHAPE STEEL

TECHNICAL FIELD

A blank can be rolled by an intermediate universal mill into a shape so that a flange thereof is open to both sides, and can then be rolled in the horizontal and vertical directions into an H-shaped steel by vertical rolls of a finish universal mill in shape steel rolling. The present invention relates to a method and an apparatus for rolling a shape steel by carrying out edging rolling using an edger mill having box calibers and by quickly shifting these calibers.

BACKGROUND ART

Conventionally, large H-shaped steels are generally produced by rough rolling a beam blank, a bloom or a slab produced by continuous casting, etc., by using a breakdown mill and then conducting intermediate rolling or finish rolling in a universal mill, etc. FIG. 1 shows the layout of the most typical shape-steel mill. It includes a breakdown mill BD comprising grooved horizontal rolls 1 and 2 that together form a vertical pair, an intermediate universal mill UR equipped with horizontal rolls 3 and 4 and vertical rolls 5 and 6 that are so arranged as to oppose one another in the vertical and horizontal directions, respectively, an edger mill E equipped with horizontal rolls 7 and 8 that together form a vertical pair, and a finish universal mill UF equipped with horizontal rolls 9 and 10 and vertical rolls 11 and 12 that are so arranged as to oppose one another in the vertical and horizontal directions, respectively. As shown at the intermediate and lower stages of FIG. 1, a predetermined shape steel is rolled and produced by using the shape steel mill by carrying out a plurality of reverse passes at the breakdown mill BD, a plurality of reverse passes at the intermediate universal mill UR and the edger mill E and a single pass at the finish universal mill UF.

FIG. 2 shows a shape steel mill which is proposed in Japanese Unexamined Patent Publication (Kokai) No. 52-88565 and makes the setup of the conventional shape steel mill compact in FIG. 1, and the finish universal mill UF is installed in the proximity of the edger mill E. The rolling pass schedule of this rolling mill is shown at the lower stage of FIG. 2. In other words, after a reverse rolling is carried out in a plurality of passes at the breakdown mill, reverse rolling is carried out in a plurality of passes at the intermediate universal mill UR and the edger mill E, and one-pass rolling is thereafter carried out at the finish universal mill UF.

FIG. 3 shows a shape steel rolling mill proposed in Japanese Unexamined Patent Publication (Kokai) No. 63-52701. According to this prior art technology, the intermediate universal mill UR, the edger mill E and the finish universal mill UF are disposed adjacent to one another, and the H-shaped steel is produced by passing the blank through these mills in a plurality of passes. In the drawing, reference numeral 14 denotes a heating furnace.

In the rolling mill of the prior art example shown in FIG. 1, the upper and lower horizontal rolls 3 and 4 of the intermediate universal mill UR have the shape represented by the solid lines shown in FIG. 4(*a*), and the flange of the H-shaped steel as the to-be-rolled material is opened to both sides. (Hereinafter, rolling of the H-shaped steel into such a shape will be called "X-shape rolling".) The horizontal roll 3 (and the horizontal roll 4, too) is worn out in the course of use as indicated by dash lines in FIG. 4(*b*) but when grinded, the roll 3 can secure a predetermined width b and can be used for the to-be-rolled material 15 of the H-shaped steel having the same size.

On the other hand, the width b1 of the upper and lower horizontal rolls 9 and 10 of the finish universal mill UF has a predetermined shape in a radial direction so as to be match with the final product of the H-shaped steel as shown in FIG. 5(*a*), and the H-shaped steel as the to-be-rolled material is rolled into an H shape (hereinafter, rolling of the H-shaped steel into such a shape will be called "H shape rolling") by using the upper and lower horizontal rolls 9 and 10 and the right and left vertical rolls 11 and 12. However, this width b1 changes to a width b2 in the course of use for a predetermined time as shown in FIG. 5(*b*) and even when it is grinded and modified, the predetermined roll width b1 cannot be secured. Therefore, the rolls are used for rolling of a product of a smaller product size in the next rolling operation. In other words, there remains the problem that the roll consumption of the finish universal mill is inferior to the roll consumption of the intermediate universal mill UR.

Next, in the rolling mill described in Japanese Unexamined Patent Publication (Kokai) No. 52-88565 shown in FIG. 2, the finish universal mill UF is disposed closer to the edger mill E so that it can be installed in a narrower space, but shaping of rolling is fundamentally the same as the prior art example shown in FIG. 1. However, the roll consumption unit of the finish universal mill UF is inferior and eventually, the running cost is high. For this reason, the finish universal mill UF is used for rolling in only the final single pass.

In Japanese Unexamined Patent Publication (Kokai) No. 63-52701 shown in FIG. 3, a plurality of normal and reverse rolling passes are carried out by using the intermediate universal mill UR, the edger mill E and the finish universal mill UF. Therefore, the improvement of the roll consumption unit of the finish universal mill UF described above is not made. Therefore, the rolling mill of Japanese Unexamined Patent Publication (Kokai) No. 63-52701 proposes a negative counter-measure of setting the surface reduction ratio of the finish universal mill UF to 15 to 55% of that of the intermediate universal mill.

Further, as X shape rolling and H shape rolling are repeated, the flange of the H-shaped steel is repeatedly turned up and down, but if the thickness of the flange of the H-shaped steel is as great as 60 to 80 mm at the initial stage of the reverse pass, a biting error occurs to invite miss-rolling, and this renders a critical problem which inhibits productivity.

DISCLOSURE OF INVENTION

In view of the problems described above, the present invention is directed to provide a rolling method which can improve dimensional accuracy by improving the roll consumption unit of rolls, can improve stability of rolling and can produce a shape steel with high productivity, and an apparatus for the rolling method. The gist of the present invention resides in the following points.

(1) A rolling method for a shape steel characterized in that a to-be-rolled material having a dog bone-like shape and rough rolled by a single or a plurality of breakdown mills is reverse rolled by using an intermediate universal mill for carrying out X-shape rolling, a quick shift edger mill having a plurality of box calibers having different sizes, and carrying out edging rolling by quickly shifting one of the box calibers corresponding to each pass schedule, and a finish universal mill for carrying out H-shape rolling for raising flanges on both sides.

(2) A rolling method for a shape steel for reverse rolling at least several times a to-be-rolled material having a dog bone-like shape and rough rolled by a single or plurality of breakdown mills, by using an intermediate universal mill for carrying out X-shape rolling, an edger mill for carrying out edging rolling and a finish universal mill for raising flanges on both sides, characterized in that at least one pass of rolling of the finish universal mill for carrying out the H-shape rolling is omitted.

(3) A rolling method according to the item 2, which uses a quick shift edger mill having a plurality of box calibers having different sizes, and carrying out edging rolling by quickly shifting one of the box calibers corresponding to each pass schedule, is used as the edger mill.

(4) A rolling method according to the item 2 or 3, wherein omission of the rolling pass of the finish universal mill is carried out at the initial stage of the reverse rolling to be carried out at least several times.

(5) A rolling method according to the item 2 or 3, wherein omission of the rolling pass of the finish universal mill is carried out intermittently during the reverse rolling to be carried out at least several times.

(6) A rolling apparatus for a shape steel for rolling a to-be-rolled material rough rolled by a single or plurality of breakdown mills, comprising an intermediate universal mill for rolling the to-be-rolled material into an X-shape, equipped with abacus-shaped vertical rolls on both right and left sides; a quick shift edger mill including an edger roll equipped with a plurality of kinds of box calibers for rolling an edge portion of a flange of the to-be-rolled material in accordance with a pass schedule, and quick shift means for allowing the box calibers of the edger roll to move in a transverse direction with respect to a rolling line; a finish universal mill for rolling the to-be-rolled material having an X-shape into an H-shape, equipped with right circular cylindrical vertical rolls on both right and left sides; and the intermediate universal mill, the quick shift edger mill and the finish universal mill are disposed adjacent to one another.

BEST MODE FOR CARRYING OUT THE INVENTION

The modes which embody the present invention will be explained with reference to the accompanying drawings.

Figures 6A, 6B, 6C:
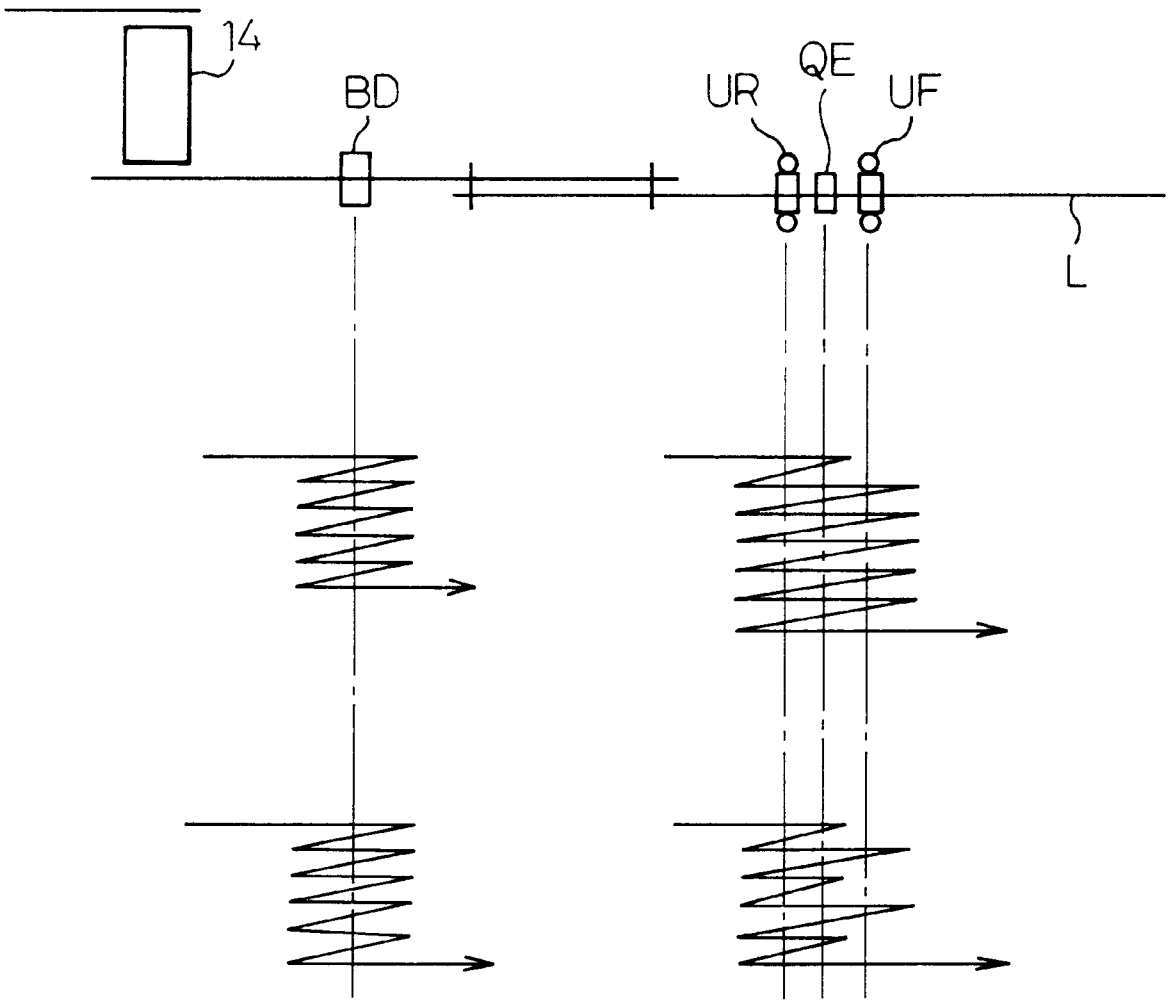
FIGS. 6(*a*), 6(*b*) and 6(*c*) are schematic explanatory views showing a rolling mill according to a first embodiment of the present invention, FIG. 6(*a*) shows a layout, FIG. 6(*b*) shows a pass schedule omitted once, FIG. 6(*c*) shows a pass schedule omitted three times.
Figure 7:
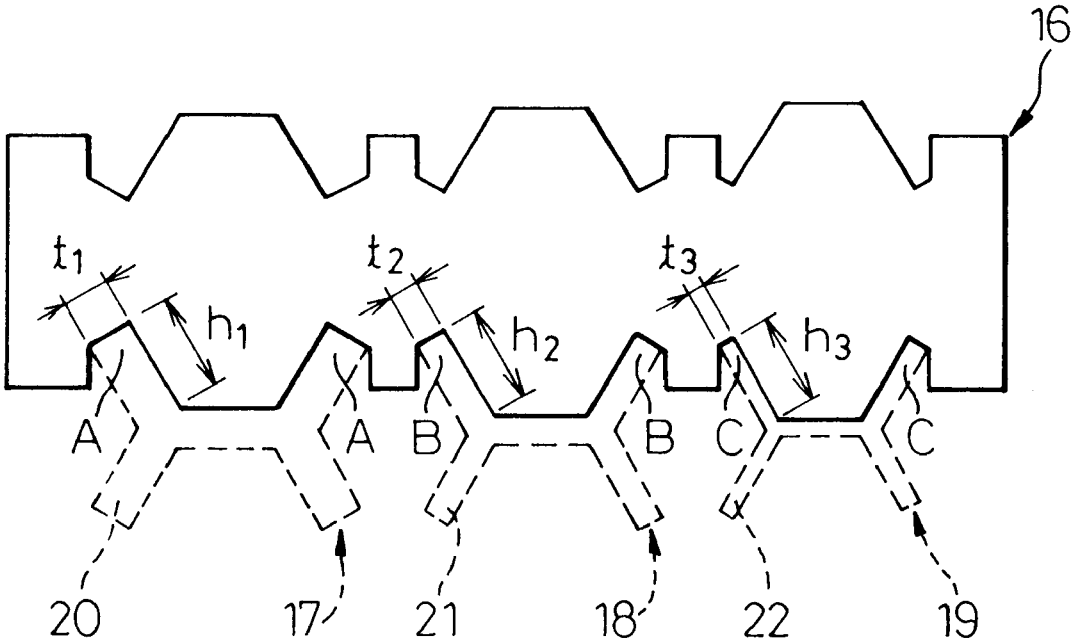
FIG. 7 is an explanatory view of a roll of a quick shift edger mill.
Figure 8A:
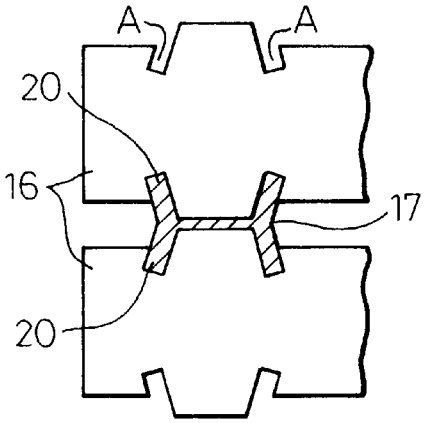
FIGS. 8(*a*)–8(*f*) are explanatory views of edging rolling, FIG. 8(*a*) shows a rolling state, FIG. 8(*b*) shows a metal-flow, FIG. 8(*c*) shows a rolling state, FIG. 8(*d*) shows a metal flow, FIG. 8(*e*) shows an angle β of a caliber, FIG. 8(*f*) shows an angle B of a caliber.
Figure 8B:
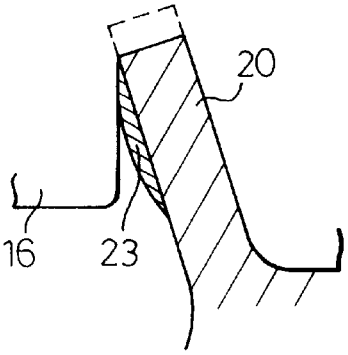
Figure 8C:
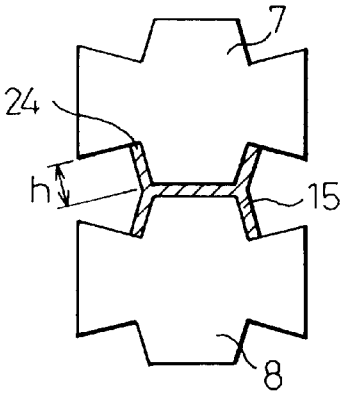
Figure 8D:
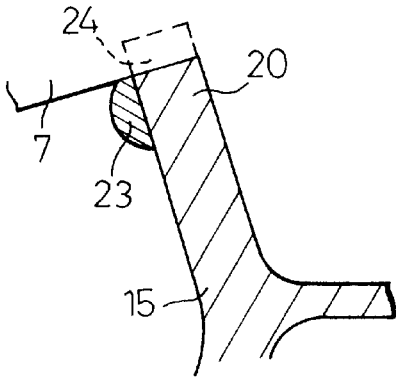
Figure 8E:
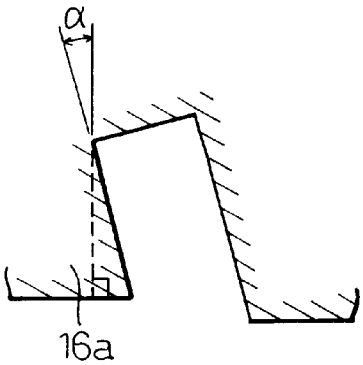
Figure 8F:
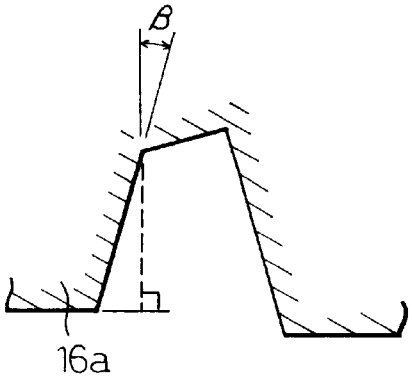
Figure 9A:
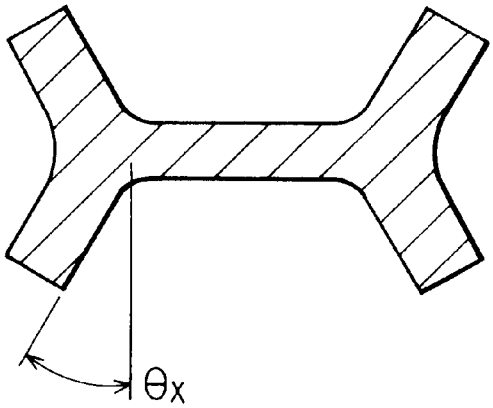
FIGS. 9(*a*)–9(*c*) are explanatory views of a rolling form of an H-shaped steel, FIG. 9(*a*) show a X-shaped rolling, FIG. 9(*b*) shows a QE-shaped rolling, FIG. 9(*c*) shows an H-shaped rolling.
Figure 9B:
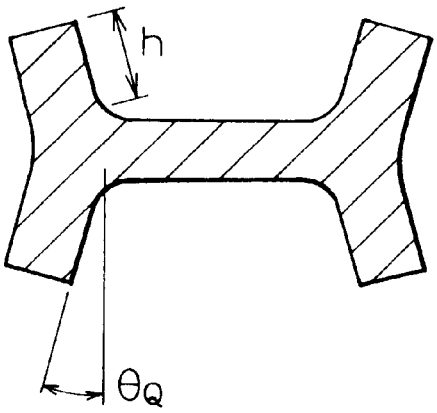
Figure 9C:
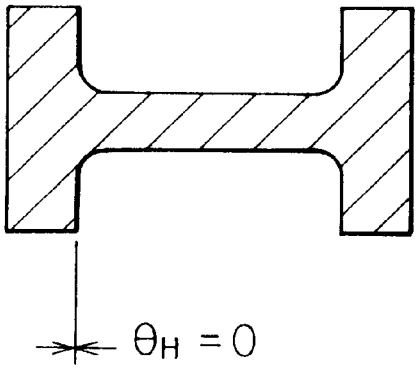

FIG. 6 is a schematic explanatory view of a rolling mill according to an embodiment of the present invention, FIG. 7 is an explanatory view of an edger roll of a quick shift edger mill, FIG. 8 is an explanatory view of edge rolling, and FIG. 9 is an explanatory view of rolling mode of an H-shaped steel.

As shown in FIG. 6, the rolling mill according to one embodiment of the present invention includes an intermediate universal mill UR continuing a breakdown mill BD at a subsequent stage, a quick shift edger mill QE and a finish universal mill UF, and these mills are disposed adjacent to one another.

Since these breakdown mill BD, intermediate universal mill UR and finish universal mill UF have the same basic constructions as those of the prior art shown in FIGS. 1 to 5, their detailed explanation will be omitted.

As shown in FIG. 7, the quick shift edger mill QE interposed at the intermediate portion between the intermediate universal mill UR and the finish universal mill UF is equipped at upper and lower edge rolls 16 thereof with box-shaped calibers A to C for rolling intermediate roll products 17 to 19 of H-shaped steels while the flanges 20 to 22 of these intermediate roll produces are fitted into the calibers A to C, respectively. The width $t_1$ to $t_3$ of each of these calibers A to C becomes progressively smaller while its depth $h_1$ to $h_3$ changes gradually so that the intermediate roll products 17 to 19, which are rough rolled, gradually approach to the flange size of the H-shaped steel as the final product. Quick shift means equipped with a reciprocation driving source such as a hydraulic cylinder, etc., not shown, is provided to the quick shift edger mill QE so that this quick shift edger mill QE can move any of its box calibers A to C to the center of the rolling line L within a short time.

Next, an example of the rolling method using this rolling mill will be explained.

As shown in FIG. 6, a to-be-rolled material 13 which has a square sectional shape and which is heated to 1,250 to 1,300° C. in a heating furnace 14 is reverse rolled 7 to 13 times in total by the breakdown mill BD to produce the intermediate rolled product which is rough rolled. This intermediate rolled product is reverse rolled by the intermediate universal mill UR, the quick shift edger mill QE and the finish universal mill UF on the basis of a pass schedule. In the first or second rolling operation (once, in this embodiment), the intermediate rolled product is rolled by using the intermediate universal mill UR and the quick shift edger mill QE, and remaining rolling is carried out by reverse rolling by using the intermediate universal mill UR, the quick shift edger mill QE and the finish universal mill UF.

When the number of times of reverse rolling is five in the rolling operations described above, for example, the first and second passes are carried out by the box caliber A in the quick shift edger mill QE, the third and fourth passes, by the box caliber B by operating the quick shift means of the quick shift edger mill QE, and the final fifth pass, by the box caliber C by operating further the quick shift means.

As described above, this embodiment can improve the roll consumption unit, dimensional accuracy and stability of rolling in comparison with the conventional rolling methods, by using the quick shift edger mill QE.

In the rolling method of the shape steel according to another embodiment shown in FIG. 6(*c*), H shape rolling is omitted every once or twice (for each time in this embodiment) in reverse rolling by the intermediate universal mill UR, the quick shift edger mill QE and the finish universal mill UF.

As shown in FIGS. 6(*b*) and 6(*c*), when H shape rolling is omitted in reverse rolling which is carried out at least several times, the possibility of the occurrence of biting mistakes (miss-rolling) can be reduced, and stability of rolling can be secured.

Particularly when the thickness of the flange of the H-shaped steel is as great as 60 to 80 mm at the initial stage of rolling, the biting mistakes (miss-rolling) are likely to occur when the steel is passed through the mills up to the finish universal mill UF. Since the first H-shape rolling operation is omitted in this embodiment, the possibility of the rolling mistakes can be reduced.

Next, the improvement of the consumption unit will be explained.

Figure 4A:
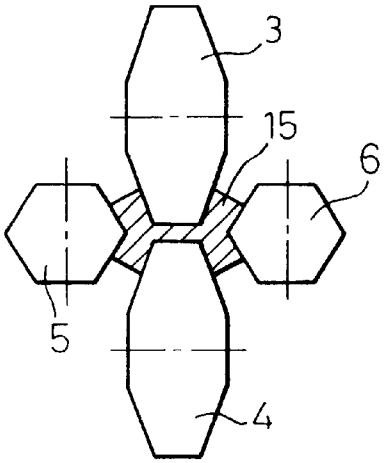
FIGS. 4(*a*) and 4(*b*) are explanatory views of an intermediate universal mill rolling according to a prior art example, FIG. 4(*a*) shows a rolling state, FIG. 4(*b*) shows a wear state.
Figure 4B:
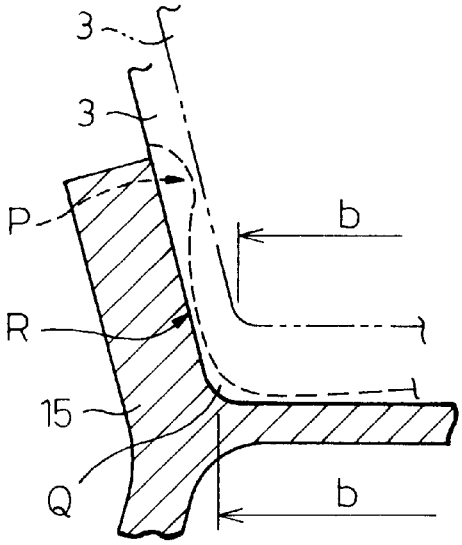
Figure 5A:
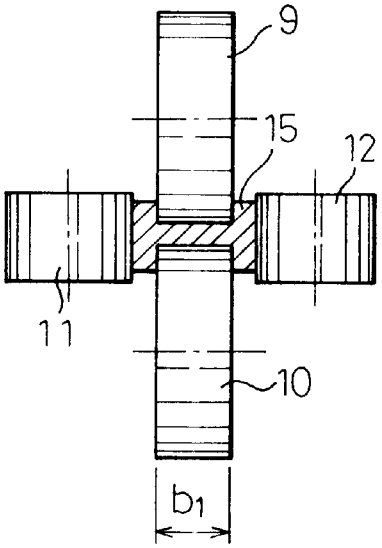
FIGS. 5(*a*) and 5(*b*) are explanatory views of finish universal mill rolling according to a prior art example, FIG. 5(*a*) shows a rolling state.
FIG. 5(b) shows a wear state.
Figure 5B:
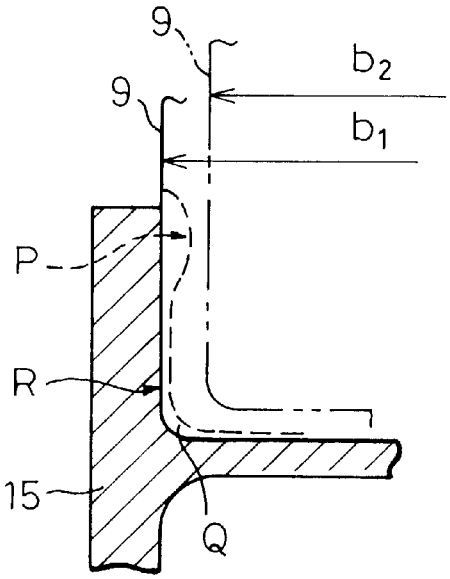

The wear state of the roll due to rolling can be broadly classified into the portion P which comes into contact with the flange end portions of the to-be-rolled material, the portion Q which comes into contact with the root of the web of the to-be-rolled material and the portions R which come into contact with other portions of the to-be-controlled material, as shown in FIGS. 4(*b*) and 5(*b*). Among them, the portion P which comes into contact with the flange end portion of the to-be-rolled material is the most important portion, and the roll consumption unit can be remarkably improved by improving the wear of this portion.

Here, the wear mechanism of the roll at the flange edge portion P will be examined. FIGS. 8(*c*) and 8(*d*) show the metal flow in edger rolling according to the prior art. In other words, the metal 24 shown in FIG. 8(*d*) is pushed by upper and lower horizontal rolls (edger rolls) 7 and 8, flows in the transverse direction and then outside the edge portion of the flange 20 as shown in FIG. 8(*d*) and forms an excess thickness 23. This protruding excess thickness 23 invites a local wear on the horizontal roll coming into contact with the flange edge portion in universal rolling of the next pass as shown in FIGS. 4(*b*) and 5(*b*).

To solve this problem, if a quick shift edger mill QE equipped with upper and lower edger rolls 16 having the box calibers A to C shown in FIG. 7 is used, the metal flow changes to the flows shown in FIGS. 8(*a*) and 8(*b*), forms a thin thickness 23 outside the flange 30 and reduces the protruding local area, so that the local surface pressure can be reduced, too. Therefore, the roll wear of the intermediate universal mill UR and the finish universal mill UF at the front and back of the quick shift edger mill QE can be remarkably reduced.

When the rolling reduction of the horizontal roll is great, bulging becomes great. Therefore, wear of the intermediate universal mill UR and the finish universal mill UF becomes greater on the horizontal side surface portions, and miss-rolling becomes more likely to occur.

Figure 1:
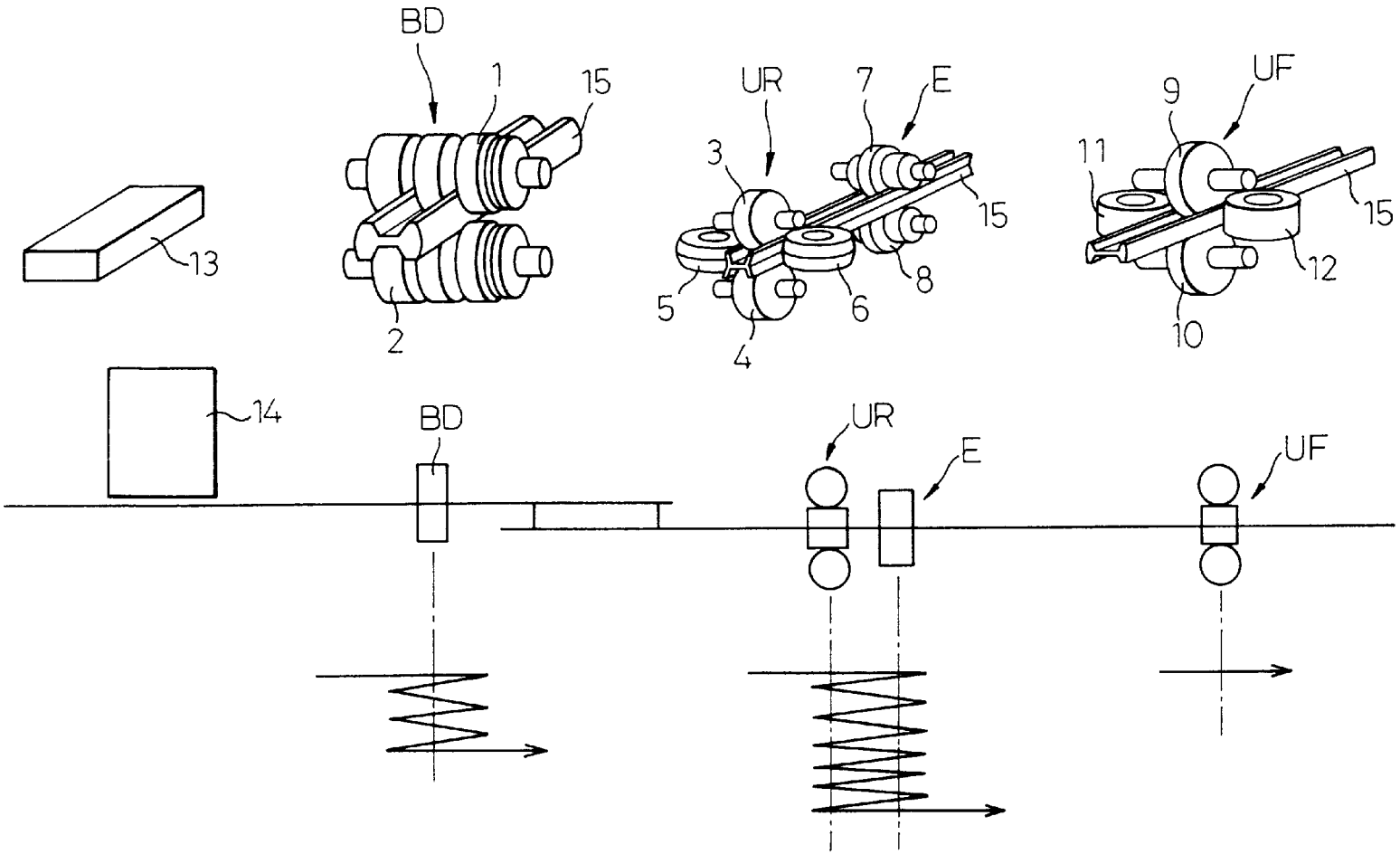
FIG. 1 is an explanatory view of a rolling method of an H-shaped steel according to a prior art example.
Figure 2:
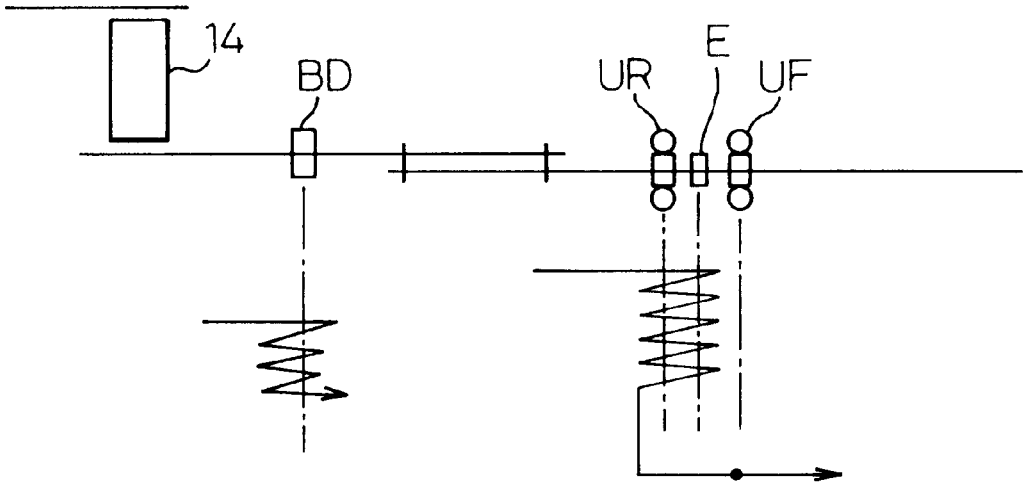
FIG. 2 is an explanatory view of a rolling method of an H-shaped steel according to prior art example.
Figure 3:
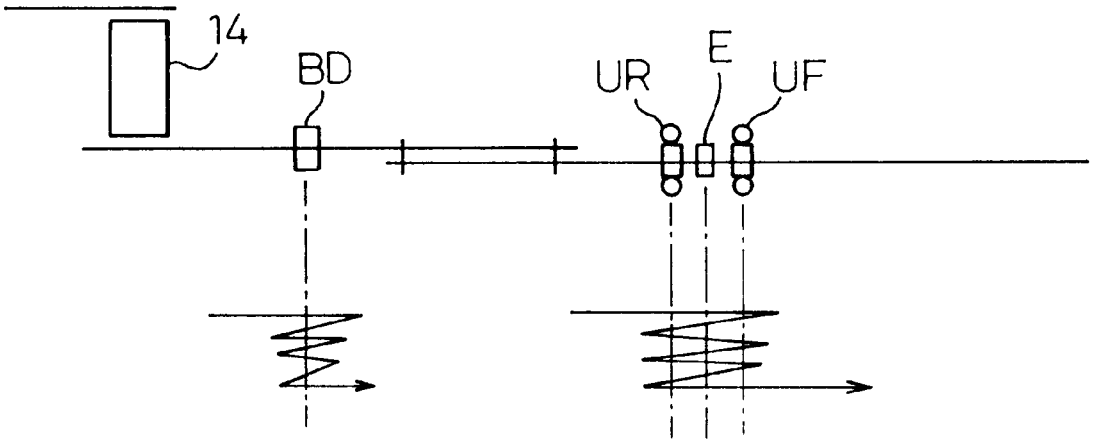
FIG. 3 is an explanatory view of a rolling method of an H-shaped steel according to prior art example.

Next, the improvement of dimensional accuracy, particularly the improvement of web deviation which is a critical factor among dimensional accuracy of the H-shaped steel, will be explained. In order to prevent web off-center, it is very important to correctly form the sizes $h_1$, $h_2$ and $h_3$ in the box calibers A to C shown in FIG. 7. The conventional rolling method rolls the flange end surface by using a pair of horizontal rolls (edger rolls) 7 and 8 as shown in FIG. 1. However, the width h of the to-be-rolled material 15 comprising the H-shaped steel varies in accordance with the rolling pass as shown in FIG. 8(*c*). Therefore, if the material 15 is rolled by the edger rolls having one kind of flange width/height, the position of the web at the center deviates. As a result, the flange width h becomes different between the upper and lower positions (refer to FIG. 9(*b*)) to thereby generate the web off-center, and dimensional accuracy becomes lower.

According to this embodiment, however, edging is carried out by the box calibers A to C having $h_1$ to $h_3$ corresponding to each width, and the web off-center can be remarkably restricted.

Next, rolling stability will be explained. In the rolling method described in Japanese Unexamined Patent Publication (Kokai) No. 63-52701 shown in FIG. 3, when rolling in the normal direction is carried out from the intermediate universal mill UR to the finish universal mill UF and reverse rolling is carried out from the finish universal mill UF to the intermediate universal mill UR, the motion of the flange of the H-shaped steel as the to-be-rolled material repeats the forms of X-shaped rolling and H-shaped rolling for each pass as shown in FIGS. 9(*a*) and 9(*c*), respectively. In the passes at the initial stage, the thickness of the flange is generally as great as 60 to 80 mm. Even though the temperature of the to-be-rolled material is a high temperature of 900 to 1,000° C., a biting mistake is likely to occur when the web is caught by the stand of the next pass while the flange is being deformed. To prevent this problem, the present embodiment sets the angle θQ of the box caliber of the upper and lower edger rolls 16 of the quick shift edger mill QE to an intermediate angle between the flange angle θx in X-shaped rolling and the flange angle $\theta_H$ in H-shaped rolling, and carries out quick shift edger mill rolling QE (QE rolling) by making the connection between these angles smooth. In the case of this quick shift edger mill, the intermediate angle is changed at the predating stage, the middle stage and the subsequent stage of the reverse pass in accordance with the pass schedule. Accordingly, the angles of the box calibers A to C can be changed and rolling can be carried out smoothly.

According to these new technologies, it becomes possible to improve production efficiency of rolling of shape steels, dimensional accuracy of the products and the fundamental unit of various rolls, and to reduce the cost and the space of installation.

By the way, in connection with the shape of the box caliber of the edger roll 16, the protruding distance of the excess thickness can be reduced by setting the side wall portion 16*a* touching the flange exterior line to an angle inclining towards the to-be-rolled material (that is, by bringing β in the drawing closer to the inclination of the flange of the to-be-rolled material), as shown in FIG. 8(*e*). This effect can be obtained, too, by setting the side wall portion 16*a* to an angle β which somewhat inclines to the side opposite to the to-be rolled material as shown in FIG. 8(*f*) in consideration of ease of roll modification and grinding, the strength of the rolls, passability at the time of rolling, and so forth, depending on the kinds and sizes of the products.

Even when the horizontal roll that constitutes the conventional edger mill E is used as the edger mill in place of the quick shift edger mill QE described above, the probability of the occurrence of the miss-rolling can be reduced by appropriately omitting H-shape rolling by the finish universal mill UF when reverse rolling is carried out several times by using the intermediate universal mill UR, the edger mill E and the finish universal mill UF.

INDUSTRIAL APPLICABILITY

In the rolling method of the shape steels according to the present invention, at least one pass is omitted in H-shape rolling. In consequence, the probability of miss-rolling decreases, and the local wear of the rolls of the universal mills can be reduced.

Particularly because the present invention uses the quick shift edger mill having a plurality of box calibers having varying sizes, buldging decreases and the local roll wear of the intermediate universal mill and the finish universal mill at the front and back of the quick shift edger mill can be reduced.

Consequently, the present invention can improve dimensional accuracy of the H-shaped steels and can further improve rolling of stability due to the reduction of miss-rolling.

Furthermore, because H-shape rolling by the finish universal mill is carried out at the initial stage, missrolling occurring when the flange of a thick H-shaped steel is fitted into the finish universal mill can be reduced, and rolling stability can be further improved. At the same time, the layout of mills can be made compact, and productivity can be improved.

We claim:

1. A rolling method of a shape steel characterized in that a to-be-rolled material having a dog bone-like shape and rough rolled by a single or plurality of breakdown mills is reverse rolled by a plurality of rolling passes, with each rolling pass using in sequence an intermediate universal mill for carrying out X-shape rolling, a quick shift edger mill having a plurality of box calibers having different sizes, and carrying out edging rolling by quickly shifting one of said box calibers corresponding to each pass schedule, and a finish universal mill for carrying out H-shape rolling for raising flanges on both sides.

2. A rolling method of a shape steel for reverse rolling at least several times a to-be-rolled material having a dog bone-like shape and rough rolled by a single or plurality of breakdown mills, said reverse rolling comprising a plurality of rolling passes, with a rolling pass comprising using in sequence an intermediate universal mill for carrying out X-shape rolling, an edger mill for carrying out edging rolling and a finish universal mill for carrying out H-shape rolling for raising flanges on both sides, said method further comprising that in at least one pass of rolling, said finish universal mill for carrying out said H-shape rolling is omitted.

3. A rolling method according to claim 2, which uses a quick shift edger mill having a plurality of box calibers having different sizes, and carrying out edging rolling by quickly shifting one of said box calibers corresponding to each pass schedule, is used as said edger mill.

4. A rolling method according to claim 2, wherein omission of said rolling pass of said finish universal mill is carried out at the initial stage of said reverse rolling to be carried out at least several times.

5. A rolling method according to claim 2, wherein omission of said rolling pass of said finish universal mill is carried out intermittently during said reverse rolling to be carried out at least several times.

6. A rolling apparatus of a shape steel for rolling a to-be-rolled material rough rolled by a single or plurality of breakdown mills, comprising:

an intermediate universal mill for rolling said to-be-rolled material into an X-shape, equipped with x-shaped or tapered vertical rolls on both right and left sides;

a quick shift edger mill including an edger roll equipped with a plurality of kinds of box calibers for rolling an edge portion of a flange of said to-be-rolled material in accordance with a pass schedule, and quick shift means for allowing said box calibers of said edger roll to move in a transverse direction with respect to a rolling line;

a finish universal mill for rolling said to-be-rolled material having an X-shape into an H-shape, equipped with right circular cylindrical vertical rolls on both right and left sides; and said intermediate universal mill, said quick shift edger mill and said finish universal mill are disposed adjacent to one another.

* * * * *